US006029029A

United States Patent [19]

Danzuka

[11] Patent Number: 6,029,029

[45] Date of Patent: Feb. 22, 2000

[54] IMAGE FORMING APPARATUS

[75] Inventor: Mitsuka Danzuka, Kawasaki, Japan

[73] Assignee: Canon Kabushiki Kaisha, Tokyo, Japan

[21] Appl. No.: 09/025,034

[22] Filed: Feb. 18, 1998

[30] Foreign Application Priority Data

Feb. 20, 1997 [JP] Japan ..... 9-036743

[51] Int. Cl.[7] ..... G03G 15/02

[52] U.S. Cl. ..... 399/100; 399/9; 399/176

[58] Field of Search ..... 399/9, 24, 26, 399/34, 43, 71, 98, 100, 174, 176, 343, 345

[56] References Cited

U.S. PATENT DOCUMENTS 5,499,078 3/1996 Kurokawa et al. ..... 399/31

5,532,795 7/1996 Tatsumi et al. ..... 399/170

5,557,373 9/1996 Miyashita et al. ..... 399/9

5,636,009 6/1997 Honda et al. ..... 399/176 X

*Primary Examiner*—Arthur T. Grimley

*Assistant Examiner*—Sophia S. Chen

*Attorney, Agent, or Firm*—Fitzpatrick, Cella, Harper & Scinto

[57] ABSTRACT

An image forming apparatus includes a movable image bearing member, a charging member capable of contacting with the image bearing member to charge the image bearing member, a cleaning member capable of contacting with the charging member to clean the surface of the charging member, a detecting circuit for detecting a parameter related to the deteriorated state of the surface of the image bearing member, and a controller for controlling the frequency of the cleaning member on the basis of the result of the detection by the detecting circuit.

15 Claims, 6 Drawing Sheets

IMAGE FORMING APPARATUS

BACKGROUND OF THE INVENTION

1. Field of the Invention

This invention relates to an image forming apparatus such as a copying apparatus, a laser beam printer or a facsimile apparatus utilizing the electrophotographic process, and particularly to an image forming apparatus provided with a contact charging member as a charging means.

2. Related Background Art

In a prior-art image forming apparatus utilizing the electrophotographic process, a corona charger has often been used as means for charging a drum type electrophotographic photosensitive body (hereinafter simply referred to as the photosensitive body) as an image bearing member. The corona charger is disposed in a non-contact and in an opposed relationship with the photosensitive body and the surface of the photosensitive body is exposed to discharge corona created by the corona charger to thereby charge the surface of the photosensitive body to a predetermined polarity and potential.

Also, in recent years, a contact charging device (a direct charging device) has been put into practical use because it has advantages, such as low ozone and low electric power as, compared with the corona charger. The charging member to which a voltage has been applied is brought into contact with the photosensitive body to thereby charge the surface of the photosensitive body to predetermined polarity and potential.

FIG. 8 of the accompanying drawings is a schematic view showing an example of an image forming apparatus using the contact a charging device as charging means. This image forming apparatus is provided with a drum type photosensitive body 101 as an image bearing member as a main constituent, and a charging roller 102 as a contact charging device, an exposure device 103, a developing device 104, a transfer roller 105 and a cleaning blade 106 around the photosensitive body.

In the image forming apparatus thus constructed, during image formation, the photosensitive body 101 is rotatively driven by driving means (not shown) and is charged by the charging roller 102 which is rotated following the photosensitive body 101. Image exposure L by a laser beam is given to the charged photosensitive body 101 by the exposure device 103, whereby an electrostatic latent image conforming to image information inputted is formed, and this electrostatic latent image is developed as a toner image by the developing device 104. The toner image on the photosensitive body 101 is transferred to a transfer material P, such as paper, by the transfer roller 105, and the transfer material P to which the toner image has been transferred is conveyed to a fixating device (not shown), by which the transferred toner image is fixated as a permanently secured image, and the transfer material P is discharged. Also, any untransferred toner adhering to the photosensitive body 101 after the transfer is removed by the cleaning blade 106, and the photosensitive body 101 having had its surface cleaned repetitively enters the next image forming operation.

Also, the charging roller 102 is provided with a pad-like or brush-like cleaning member (not shown), which is adapted to be urged against the charging roller 102 to thereby periodically remove any toner adhering to the charging roller 102 and the scrapings of the photoconductive layer of the photosensitive body 101.

Now, in the above-described prior art image forming apparatus, as the frequency of image formation increases, the surface of the photosensitive body 101 is scraped by the cleaning blade 106 and the developer of the developing device 104, whereby the surface roughness of the photosensitive body 101 gradually becomes greater. Particularly, with regard to the untransferred toner slipping away from the cleaning blade 106, localized slip-away becomes greater in amount as the surface roughness of the photosensitive body 101 becomes greater. As the result, when the frequency of image formation increases and the deterioration of the surface of the photosensitive body 101 progresses, the degree of stain of the charging roller 102 becomes great as compared with the initial stage and thus, cleaning becomes insufficient if only the cleaning member (not shown) of the charging roller 102 is used. Therefore, as the charging roller 102 becomes stained, the irregularity of charging occurs and it becomes impossible to effect good image formation.

As a countermeasure for this, it is conceivable to simply increase the cleaning capability of the cleaning member, but this has led to the problem that the load of the cleaning member to the charging roller 102 becomes great and the surface of the charging roller 102 becomes liable to be damaged and the life of the charging roller 102 becomes short and also the deterioration of the cleaning member is hastened to thereby shorten the life thereof.

It is also conceivable to make the pressure of contact of the cleaning blade 106 with the photosensitive body 101 great in order to prevent the slip-away of the untransferred toner by the cleaning blade 106, but in this case, there has been the problem that the load of the photosensitive body 101 becomes great or the so-called fusing phenomenon that the toner adheres to the surface of the photosensitive body 101 is liable to occur.

SUMMARY OF THE INVENTION

So, the present invention has as its object to provide an image forming apparatus in which the cleaning of a charging member can be effectively done and for a long period, the irregularity of charging is prevented from occurring, whereby good image formation can be effected.

DESCRIPTION OF THE PREFERRED EMBODIMENTS

First Embodiment

Figure 1:
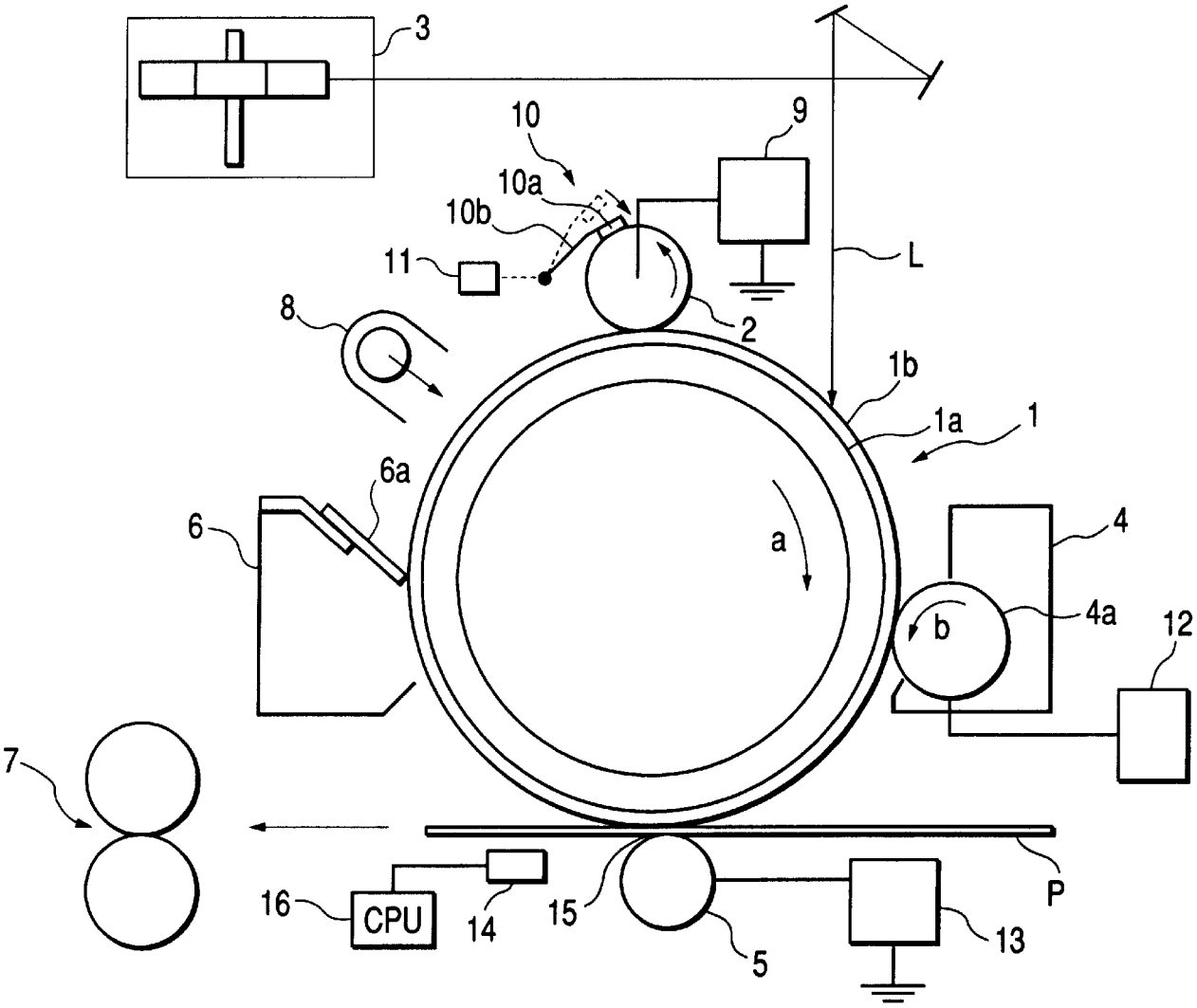
FIG. 1 schematically shows the construction of an image forming apparatus according to a first embodiment of the present invention.

FIG. 1 schematically shows the construction of an image forming apparatus according to a first embodiment of the present invention. The image forming apparatus according to the present embodiment is a laser beam printer utilizing the electrophotographic process, and uses contact charging means of the roller type as charging means for an image bearing member.

This image forming apparatus is provided with a rotatable drum type photosensitive body 1 which is an image bearing member, a charging roller 2 which is a contact charging means, an exposure device 3, a developing device 4, a transfer roller 5, a cleaner member 6, a fixating device 7 and a charge removing device (charge removing lamp) 8.

The photosensitive body 1, in the present embodiment, is an organic photosensitive body negatively charged and has a photosensitive layer 1*b* on a drum base body 1*a* made of aluminum and having a diameter of 30 mm, and is rotatively driven in the direction of arrow "a " at a predetermined process speed (e.g. 105 mm/sec.).

The charging roller 2 is disposed along and in parallelism to the axial direction of the photosensitive body 1 and is urged against the surface of the photosensitive body 1 with a predetermined pressure force by pressing means (not shown), and is rotated with the rotative driving of the photosensitive body 1. A voltage source 9 is electrically connected to the charging roller 2, and a predetermined bias voltage (in the present embodiment, a minus DC voltage having an AC voltage superposed thereon) is applied from the voltage source 9 to the charging roller 2 to thereby charge the photosensitive body 1 to a predetermined polarity and potential.

A cleaning member 10 for cleaning the surface of the charging roller 2 is disposed outside the charging roller 2. The cleaning member 10 has a pad portion 10*a* formed of a sponge material, and a support shaft 10*b* having the pad portion 10*a* secured to one end side thereof, and with the other end side of the support shaft 10*b* as a rotation fulcrum, the pad portion 10*a* is uniformly brought into contact with the whole area of the surface of the charging roller 2 in the lengthwise direction thereof, and is caused to frictionally slide on the surface of the charging roller 2 which is rotating, to thereby effect the cleaning of the surface of the charging roller 2. A driving device 11 for moving the support shaft 10*b* of the cleaning member 10 to thereby cause the pad portion 10*a* to bear against the surface of the charging roller 2 is connected to the other end side of the support shaft 10*b*.

The developing device 4, in the present embodiment, is a two-component contact developing device (a two-component magnetic brush developing device), and has a magnet roller (not shown) fixedly disposed in a non-magnetic developing sleeve 4*a* rotatively driven in the direction of arrow "b", and a predetermined developing bias voltage is applied from a voltage source 12 to the developing sleeve 4*a*.

The transfer roller 5 is contact transfer means adapted to be urged against the surface of the photosensitive body 1 and rotated with the rotative driving of the photosensitive body 1, and a predetermined transfer bias voltage is applied from a voltage source 13 thereto.

Also, in FIG. 1, the reference numeral 14 designates a number-of-sheets counting sensor, such as a photosensor, for counting the number of transfer materials P such as paper passing the transfer nip portion 15 between the transfer roller 5 and the photosensitive body 1, i.e., the number of durable sheets, and the number-of-sheets count information of the transfer materials P counted by the number-of-sheets counting sensor 14 is inputted to a control device (CPU) 16. The control device 16 outputs a driving signal to a driving device 11 on the basis of the number-of-sheets count information inputted thereto from the number-of-sheets counting sensor 14, and effects control so as to cause the pad portion 10*a* of the cleaning member 10 to bear against the surface of the charging roller 2 and remove any untransferred toner adhering to the surface of the charging roller 2. (The details of this will be described later.) The number-of-sheets count information of the transfer materials is not restricted to the use of the counting sensor, such as a photosensor, but the information of the number of copies (prints) inputted by the user of the apparatus may be stored in a memory.

The number of the transfer materials P counted by the number-of-sheets counting sensor 14 and the frequency of image formation are nearly the same values. Also, the photosensitive body 1 and the charging roller 2 has a service life which enables image formation to be done 60,000 or more times.

The operation of the above-described image forming apparatus will now be described.

During image formation, the photosensitive body 1 is rotatively driven in the direction of arrow "a" at a predetermined process speed (e.g. 105 mm/sec.) by driving means (not shown). At this time, a bias voltage comprising a DC voltage having an AC voltage superposed thereon is applied from the voltage source 9 to the charging roller 2 to thereby charge the surface of the photosensitive body 1 to the negative polarity.

Image exposure L by a laser beam is provided by the exposure device 3 to the charged surface of the photosensitive body 1, whereby there is formed an electrostatic latent image in such a form that the charge of the image portion has been removed in conformity with inputted image information. A toner charged to the same negative polarity as this electrostatic latent image is caused to adhere from the developing sleeve 4*a* to the electrostatic latent image on the surface of the photosensitive body 1 in the developing device by the reverse developing method, and the electrostatic latent image is developed as a toner image. In this case, a bias voltage comprising a DC voltage having an AC voltage superposed thereon is applied from the voltage source 12 to the developing sleeve 4*a*.

When the toner image on the surface of the photosensitive body 1 arrives at the transfer nip portion 15 between the transfer roller 5 and the photosensitive body 1, a transfer material P, such as paper, is conveyed to this transfer nip portion 15 in timed relationship therewith, and a charge of the positive polarity is imparted to the back side of the transfer material P by the transfer roller 5 to which a transfer bias voltage (a DC voltage) has been applied from the voltage source 13, whereby the toner image on the surface of the photosensitive body 1 is transferred to the surface side of the transfer material P. The transfer material P to which the toner image has been thus transferred is conveyed to the fixating device 7, by which the transferred toner image is fixated as a permanently adhering image on the transfer material P, which is then discharged.

On the other hand, after the transfer of the toner image, any attachment such as untransferred toner on the surface of the photosensitive body 1 is removed by the cleaning blade 6*a* of the cleaner member 6, and further the charge thereon is removed by the charge removing device 8 and the surface of the photosensitive body 1 is initialized for repeated use for image formation.

In the present embodiment, during image formation, the number of transfer materials P passing the transfer nip portion 15 is counted by the number-of-sheets counting sensor 14, and the counted number of transfer materials (the number of sheets on which image formation has been done) is inputted to the control device (CPU) 16. The control device 16 outputs a driving signal to the rotatively driving device 11 on the basis of the inputted number-of-sheets count information, and effects control so as to cause the pad portion 10*a* of the cleaning member 10 to bear against the surface of the charging roller 2 to thereby remove any untransferred toner or the like adhering to the surface of the charging roller 2.

The cleaning operation of the cleaning member 10 in the present embodiment will now be described in detail.

Figure 2:
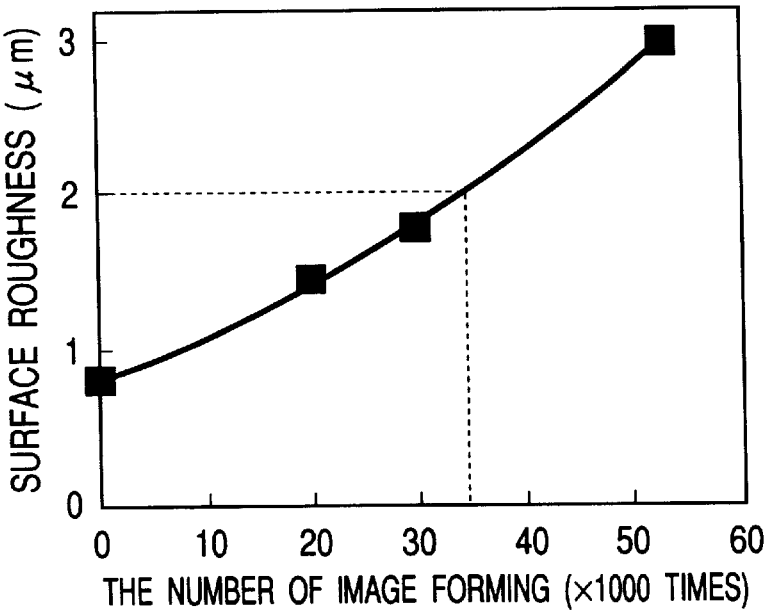
FIG. 2 is a graph showing the relation between the frequency of image formation and the surface roughness of a photosensitive body.

FIG. 2 shows the surface roughness of the photosensitive body 1 relative to the frequency of image formation during the intermittent printing of A4 size sheets. As shown in this figure, the surface roughness of the photosensitive body 1 gradually becomes greater as the frequency of image formation increases. Along therewith, the quantity of untransferred toner locally slipping away from the cleaning blade 6*a* of the cleaner member 6 also increases and the stain of the charging roller 2 also increases. Heretofore, when the surface roughness of the photosensitive body 1 reaches the order of 2 $\mu$m, the degree of the stain of the charging roller 2 has become great and the cleaning of the charging roller 2 has become difficult.

There are various methods of knowing the surface roughness of the photosensitive body 1, but in the present embodiment, use is made of a method of counting the number of transfer materials P passing the transfer nip portion 15 (the number of durable sheets) by the number-of-sheets counting sensor 14. Here, the number of durable sheets and the frequency of image formation can be regarded as substantially the same values and therefore, the relation between the number of durable sheets and the surface roughness of the photosensitive body 1 is as shown in FIG. 2.

Also, Table 1 below is the result of an experiment which examined the strength (surface state) of the charging roller 2 relative to the pad portion 10*a* of the cleaning member 10 during cleaning, and examined the surface state of the charging roller 2 when the frequency of cleaning was once per print onto the transfer material and the cleaning of the charging roller 2 was effected for 2.0 seconds each (corresponding to the four rounds of the charging roller 2). As is apparent from this table, damage occurred to the surface of the charging roller 2 when the frequency of cleaning exceeded 2,200 times.

TABLE 1

| Frequency of cleaning (2.0 sec.) | 1,000 times | 1,500 times | 2,000 times | 2,200 times |
|---|---|---|---|---|
| Surface state of the charging roller | ○ | ○ | ○ | damage occured |

So, as shown in Table 2 below, the degree of the stain of the charging roller 2 was examined with respect to a case where the number of times by which the charging roller 2 can be cleaned is 2,200 times (2.0 sec./times) and the frequency of the cleaning by the pad portion 10*a* of the cleaning member 10 is e.g. once per 27 sheets of print, with a result that the stain became remarkable for the order of 50,000 durable sheets.

TABLE 2

| Number of durable sheets (×1,000 sheets) | 10 | 20 | 30 | 40 | 50 | 60 |
|---|---|---|---|---|---|---|
| Once per 27 sheets | 5 | 5 | 4 | 3 | 2 | 1 |
| First embodiment | 5 | 4 | 3 | 3 | 3 | 3 |

(level 5: good ⟷ 1: bad)

The degree of the stain of the charging roller 2 is indicated at levels 1–5, and at level 1, the degree of the stain is most remarkable (bad), and at level 5, the degree of the stain is smallest (good), and the allowable levels of the stain are levels 3–5, and levels 1 and 2 are unallowable levels. Here, the levels of the stain are the degrees to which the stain on the charging roller 2 causes image irregularity as they were evaluated at the above-mentioned levels of 5 stages (1–5).

As is apparent from Table 2, when the frequency of cleaning is once per 27 sheets, the level of the stain lowers from the order of 40,000 durable sheets. So, in the present embodiment, a is made such that the frequency of cleaning is made small at the initial stage whereat the stain of the charging roller 2 is little, and the frequency of cleaning is increased when the number of durable sheets reaches a certain value.

That is, in the present embodiment, control is effected by the control device 16 so that at the initial stage whereat the number of durable sheets is within the order of 30,000 sheets, the cleaning of the charging roller 2 may be effected at the frequency of once per 50 sheets of print, and control is effected by the control device 16 so that when the surface roughness of the photosensitive body 1 reaches the order of 2 $\mu$m, that is, after the number of durable sheets reaches the order of 30,000 sheets, the cleaning of the charging roller 2 may be effected at the frequency of once per 20 sheets of print. The degree of the stain of the charging roller 2 in the present embodiment at this time, as shown in Table 2, was kept at allowable levels, i.e., levels 5–3, until the number of durable sheets reached 60,000 sheets, and the frequency of cleaning was generally smaller than 2,200 times, and no damage occurred to the surface of the charging roller 2.

Thus, in the present embodiment, by controlling the frequency of the cleaning of the charging roller 2 so as to be changed in conformity with the number of durable sheets, the cleaning of the charging roller 2 can be done effectively and for a long period, the irregularity of charging can be prevented and good image formation can be effected.

Second Embodiment

The basic construction of an image forming apparatus according to a second embodiment is similar to that of the first embodiment shown in FIG. 1.

In the present embodiment, at the initial stage whereat the stain of the charging roller 2 is little, the cleaning time per once is shortened, and when the number of durable sheets reaches a certain value, the cleaning time is lengthened.

That is, as shown in Table 3 below, the degree of the stain of the charging roller 2 when for example, the frequency of cleaning was once per 20 sheets and the cleaning time was changed was evaluated at the levels of 5 stages (1–5) as described above.

TABLE 3

| Number of durable sheets (×1,000 times) | 10 | 20 | 30 | 40 | 50 | 60 |
|---|---|---|---|---|---|---|
| Cleaning time 1.0 sec. | 5 | 4 | 3 | 2 | 1 | 1 |
| Cleaning time 1.5 sec. | 5 | 5 | 4 | 3 | 2 | 1 |
| Cleaning time 2.0 sec. | 5 | 5 | 4 | 4 | 3 | 3 |
| Second embodiment | 5 | 4 | 3 | 3 | 3 | 3 |

(level 5: good ⟷ 1: bad)

As is apparent from Table 3, when the cleaning time per once was 1.0–1.5 sec., the stain of the charging roller 2 assumed unallowable levels (levels 1 and 2) before the number of durable sheets reached 60,000 sheets, and when the cleaning time per once was 2.0 sec., the stain of the charging roller 2 was at allowable levels (levels 3–5) even when the number of durable sheets reached 60,000 sheets, but damage occurred to the surface of the charging roller 2 when the number of durable sheets was of the order of 45,000 sheets.

So, in the present embodiment, control is effected, by the control device 16 so that the cleaning time may be 1.0 sec. when the frequency of cleaning is once per 20 sheets of print and the surface roughness of the photosensitive body 1 reaches the order of 2 $\mu$m, that is, until the number of durable sheets reaches the order of 35,000 sheets, and the cleaning time may be 2.0 sec. until thereafter the number of durable sheets reaches 60,000 sheets. The degree of the stain of the charging roller 2 in the present embodiment at this time as shown in Table 3, was kept at allowable levels, i.e., levels 5–3, until the number of durable sheets reached 60,000 sheets, and no damage occurred to the surface of the charging roller 2.

Thus, in the present embodiment, by controlling the cleaning time of the charging roller 2 so as to be changed in conformity with the number of durable sheets, the cleaning of the charging roller 2 can be done effectively and for a long period, the irregularity of charging can be prevented and good image formation can be effected.

Third Embodiment

The basic construction of an image forming apparatus according to a third embodiment is similar to that of the first embodiment shown in FIG. 1.

In the present embodiment, at the initial stage whereat the stain of the charging roller 2 is little, the pressure contact force of the pad portion 10*a* of the cleaning member 10 with the surface of the charging roller 2 is made small, and when the number of durable sheets reaches a certain value, the pressure contact force of the pad portion 10*a* of the cleaning member 10 with the surface of the charging roller is made great.

That is, as shown in Table 4 below, the degree of the stain of the charging roller 2 when the frequency of cleaning was e.g. once per 20 sheets of print and the cleaning time was 2.0 sec. each and the pressure contact force of the pad portion 10*a* of the cleaning member 10 with the surface of the charging roller 2 was changed was evaluated at the levels of 5 stages (1–5) as described above.

TABLE 4

| Number of durable sheets (×1,000 sheets) | 10 | 20 | 30 | 40 | 50 | 60 |
|---|---|---|---|---|---|---|
| Pressure 10 g/cm | 5 | 5 | 4 | 3 | 2 | 1 |
| Pressure 15 g/cm | 5 | 5 | 4 | 4 | 3 | 3 |
| Third embodiment | 5 | 5 | 4 | 4 | 3 | 3 |

(level 5: good ⟷ 1: bad)

As is apparent from Table 4, when the pressure contact force of the pad portion 10*a* of the cleaning member 10 with the surface of the charging roller relative to the length of the charging roller 2 was 10 g/cm, the stain of the charging roller 2 assumed unallowable levels (levels 1–2) before the number of durable sheets reached 60,000 sheets, and when the pressure contact force of the pad portion 10*a* of the cleaning member 10 with the surface of the charging roller 2 was 15 g/cm, the stain of the charging roller 2 was at allowable levels (levels 3–5) even when the number of durable sheets reached 60,000 sheets, but damage occurred to the surface of the charging roller 2 when the number of durable sheets was of the order of 40,000 sheets.

So, in the present embodiment, control was effected by the control device 16 so that when the frequency of cleaning was once per 20 sheets of print and each cleaning time was 2.0 sec. and the surface roughness of the photosensitive body 1 reached the order of 2 $\mu$m, that is, until the number of durable sheets reached the order of 30,000 sheets, the pressure contact force of the pad portion 10*a* of the cleaning member 10 with the surface of the charging roller 2 might be 10 g/cm and the pressure contact force of the pad portion 10*a* of the cleaning member 10 with the surface of the charging roller 2 might be 15 g/cm until thereafter the number of durable sheets reached 60,000 sheets. The degree of the stain of the charging roller 2 in the present embodiment at this time, as shown in Table 4, was kept at allowable levels, i.e., levels 5–3, until the number of durable sheets reached 60,000 sheets, and no damage occurred to the surface of the charging roller 2.

Thus, in the present embodiment, by controlling the cleaning time of the charging roller 2 so as to be changed in conformity with the number of durable sheets, the cleaning of the charging roller 2 can be done effectively and for a long period, the irregularity of charging can be prevented and good image formation can be effected.

Fourth Embodiment

Figure 3:
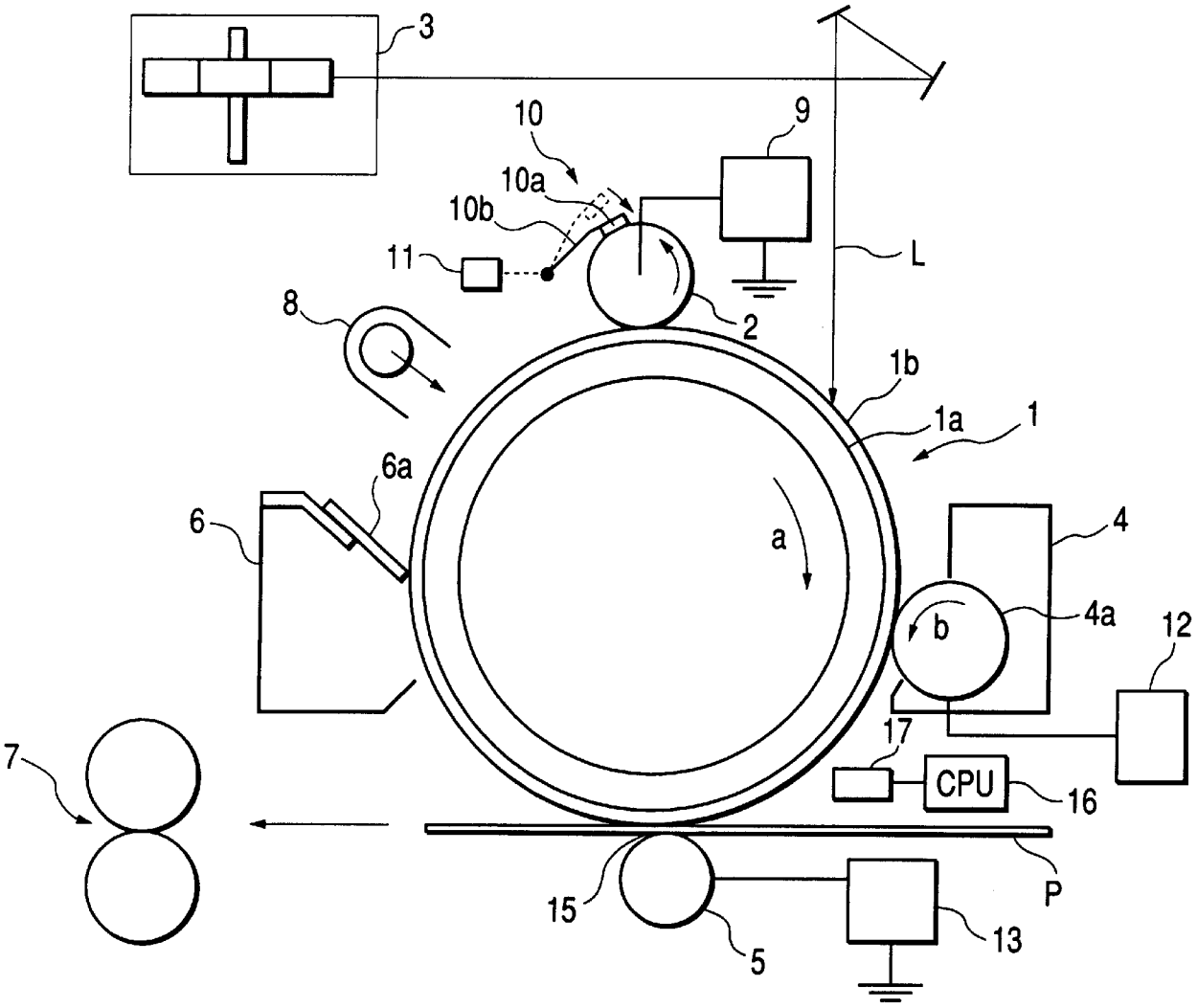
FIG. 3 schematically shows the construction of an image forming apparatus according to a fourth embodiment of the present invention.

While each of the above-described first to third embodiments is of a construction in which the number of durable sheets (the frequency of image formation) is counted as means for knowing the surface roughness of the photosensitive body 1, a fourth embodiment is of a construction in which as shown in FIG. 3, provision is made for a number-of-rotations counting sensor 17, such as a photosensor for counting the number of rotations of the photosensitive body 1, and the control device 16 outputs a driving signal to the driving device 11 on the basis of the number-of-rotations count information inputted from the number-of-rotations counting sensor 17 to thereby cause the pad portion 10*a* of the cleaning member 10 to bear against the surface of the charging roller 2 and remove any untransferred toner or the like adhering to the surface of the charging roller 2

Figure 4:
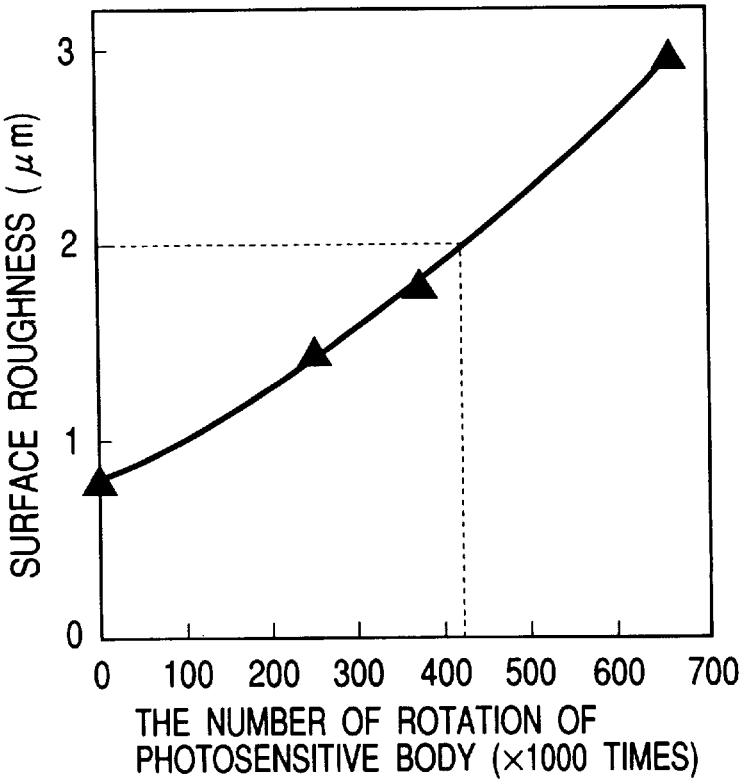
FIG. 4 is a graph showing the relation between the number of rotations of a photosensitive body and the surface roughness of the photosensitive body.

FIG. 4 shows the relation between the number of rotations of the photosensitive body 1 and the surface roughness of the photosensitive body 1, and since for the number of rotations of the order of 400,000 rotations, the surface roughness of the photosensitive body 1 reaches the order of 2 μm, the cleaning condition is changed as in the above-described first to third embodiments to thereby clean the charging roller 2 when the number of rotations of the photosensitive body 1 reaches the order of 400,000 times.

Thus, again in the present embodiment, by controlling the cleaning time of the charging roller 2 so as to be changed in conformity with the number of rotations of the photosensitive body 1, the cleaning of the charging roller 2 can be done effectively and for a long period, the irregularity of charging can be prevented and good image formation can be effected.

Fifth Embodiment

Figure 5:
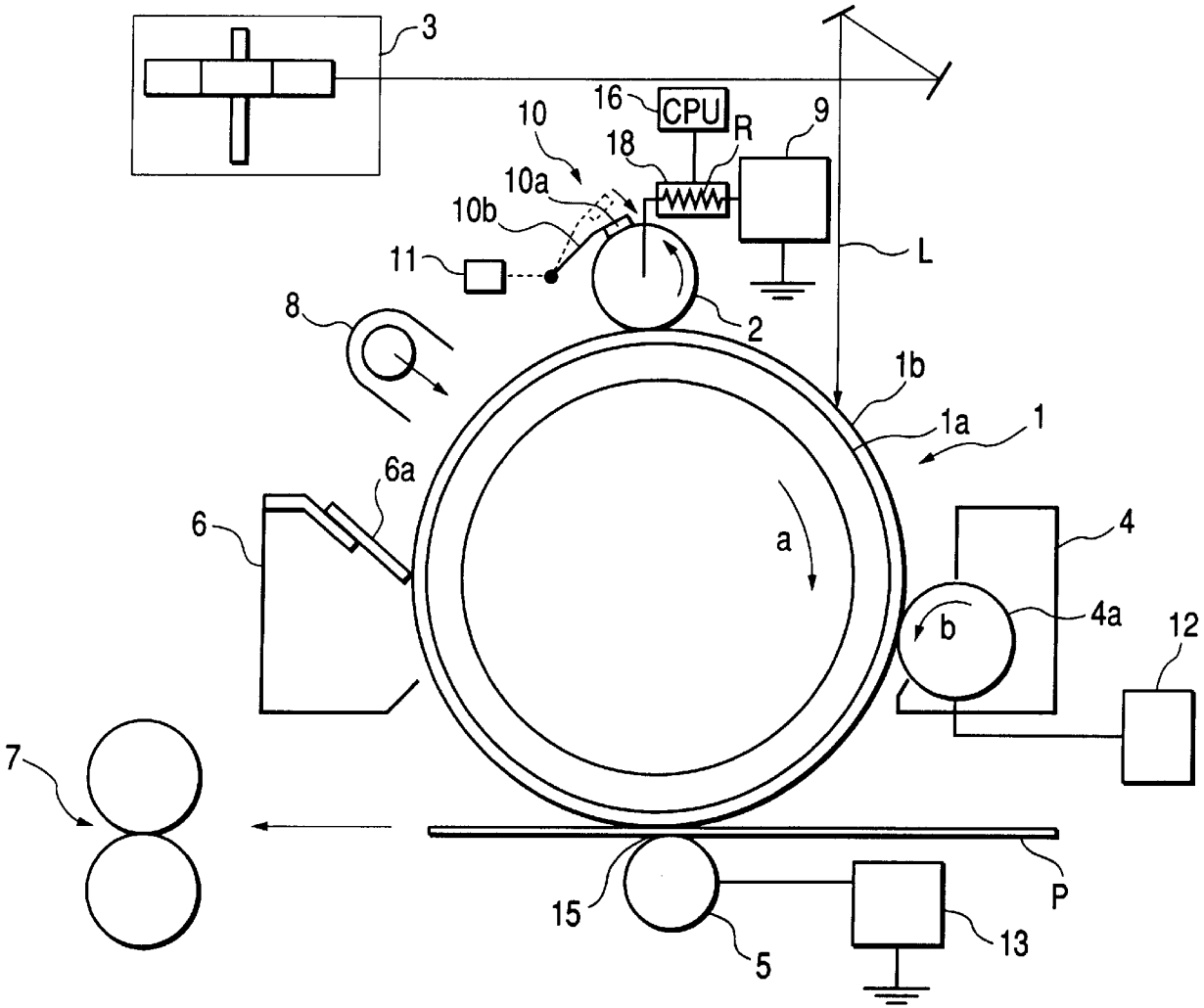
FIG. 5 schematically shows the construction of an image forming apparatus according to a fifth embodiment of the present invention.

While each of the above-described first to third embodiments is of a construction in which the number of durable sheets (the frequency of image formation) is counted as means for knowing the surface roughness of the photosensitive body 1, a fifth embodiment is of a construction in which, as shown in FIG. 5, provision is made for a detecting circuit 18 for detecting the amount of electric current flowing to the charging roller 2 when the charging roller 2 corresponds to an area which is to become the nonimage formation area of the photosensitive body 1, and in the other points, the construction of the present embodiment is similar to that of the aforedescribed embodiments.

The detecting circuit 18 has a resistor R for measuring an electric current, and is designed to measure the voltage across the resistor R when a predetermined voltage for detection is applied to the charging roller 2, thereby recognizing the film thickness of the photosensitive layer 1*b* on the surface of the photosensitive body 1.

The control device 16 is designed to effect control so as to calculate the film thickness of the photosensitive layer 1*b* on the surface of the photosensitive body 1 from the amount of electric current obtained from the detecting circuit 18, and output a driving signal to the driving device 11 on the basis of the calculated film thickness information to thereby cause the pad portion 10*a* of the cleaning member 10 to bear against the surface of the charging roller 2 and remove any untransferred toner or the like adhering the surface of the charging roller 2.

Figure 6:
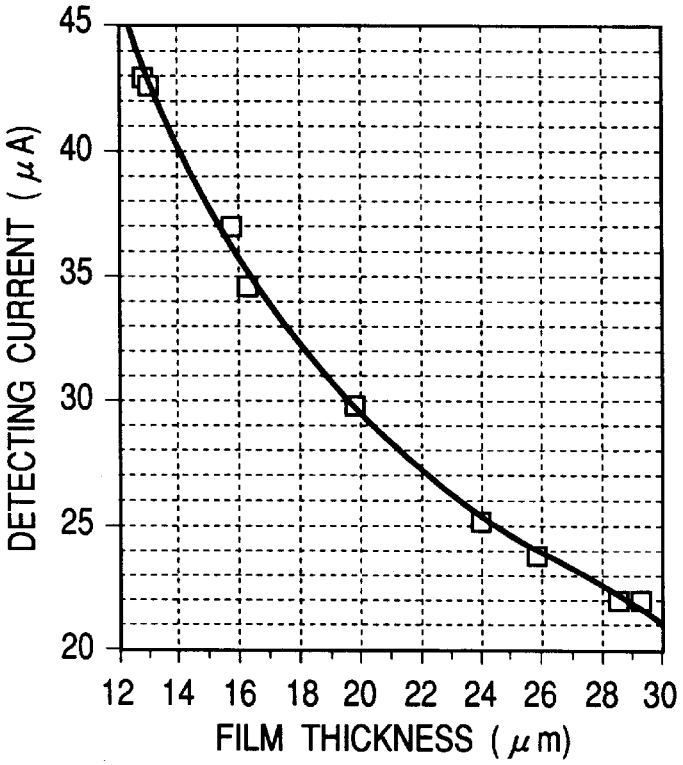
FIG. 6 is a graph showing the relation between the film thickness of the photosensitive layer of a photosensitive body and a detecting current.

FIG. 6 is a graph showing the relation between a detecting current detected by the detecting circuit 18 when for example, a bias voltage comprising a DC voltage of −750 V and an AC voltage of a rectangular peak-to-peak voltage 1500 V having a frequency of 1000 Hz and superposed on the bias voltage is applied from the voltage source 9 to the charging roller 2 and the film thickness of the photosensitive layer 1*b* on the surface of the photosensitive body 1, and at the film thickness of the photosensitive layer 1*b* decreases, the amount of electric current flowing to the photosensitive body 1 increases. Thus, as the frequency of image formation increases, the surface of the photosensitive body 1 is scraped and the film thickness of the photosensitive layer 1*b* is decreased, and along therewith, the surface roughness of the photosensitive body 1 becomes greater.

Figure 7:
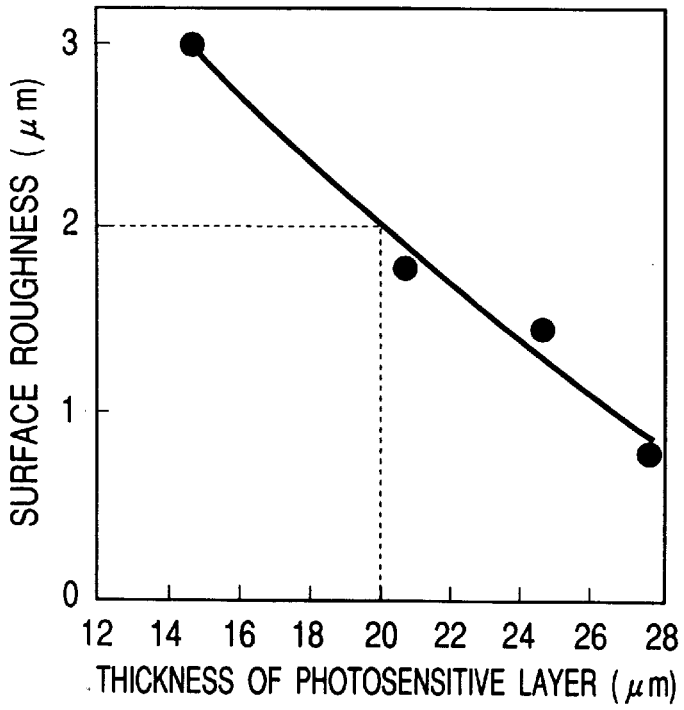
FIG. 7 is a graph showing the relation between the film thickness of the photosensitive layer of the photosensitive body and the surface roughness of the photosensitive body.
Figure 8:
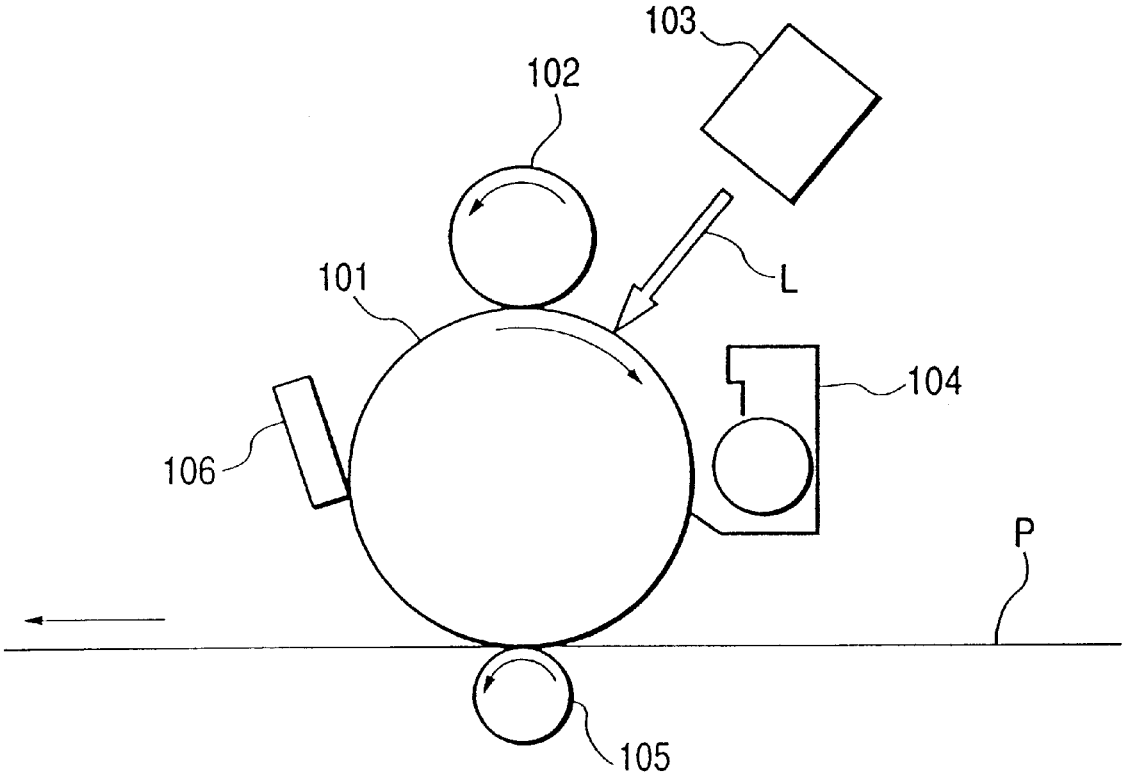
FIG. 8 (PRIOR ART)
FIG. 8 schematically shows the construction of an image forming apparatus according to the prior art.

FIG. 7 is a graph showing the relation between the film thickness of the photosensitive layer 1*b* on the surface of the photosensitive body 1 and the surface roughness of the photosensitive body 1, and when the film thickness of the photosensitive layer 1*b* is of the order of 20 μm, the surface roughness of the photosensitive body 1 reaches the order of 2 μm and therefore, when the film thickness of the photosensitive layer 1*b* reaches the order of 20 μm, the cleaning condition is changed as in the above-described first to third embodiments so as to clean the charging roller 2.

Thus, again in the present embodiment, the cleaning time of the charging roller 2 is controlled so as to be changed in conformity with the film thickness of the photosensitive layer 1*b* on the surface of the photosensitive body 1, whereby the cleaning of the charging roller 2 can be done effectively and for a long period, the irregularity of charging can be prevented and good image formation can be effected.

Also, in the present embodiment, the detecting circuit 18 is provided between the voltage source 9 and the charging roller 2, whereas this is not restrictive, but the detecting circuit 18 may be provided between the drum base 1*a* of the photosensitive body 1 and the earth or between the voltage source 9 and the earth.

While each of the above-described embodiments is of a construction in which at a point of time whereat durability has progressed to a certain degree, the cleaning condition of the charging roller 2 is changed, the change of the cleaning condition is not limited to once, but the cleaning condition may be changed stepwise at a plurality of times.

Also, the cleaning conditions in the above-described first to third embodiments may be suitably combined so that the charging roller 2 may be cleaned by the cleaning member 10.

The shape of the contact charging means is not restricted to the roller shape of the charging roller 2, and the cleaning means for the contact charging means is not limited to the pad-like one, but may be a brush-like one, a roller-like one or the like.

What is claimed is:

1. An image forming apparatus comprising:

a movable image bearing member;

a charging member capable of contacting with said image bearing member to charge said image bearing member;

a cleaning member capable of contacting with said charging member to clean a surface of said charging member;

detecting means for detecting a parameter related to a deteriorated state of a surface of said image bearing member; and control means for controlling a frequency of cleaning by said cleaning member on the basis of a detected result by said detecting means.

2. An image forming apparatus according to claim 1, wherein said frequency of cleaning is increased when the deteriorated state of the surface of said image bearing member becomes larger than a predetermined value.

3. An image forming apparatus according to claim 1, further comprising a power source for applying a voltage to said charging member.

4. An image forming apparatus according to claim 3, wherein said voltage is in the form of a voltage comprising a DC voltage and an AC voltage superposed one upon the other.

5. An image forming apparatus according to claim 1, wherein said image bearing member is provided with an electrophotographic photosensitive layer, and said apparatus has exposure means for image-exposing said image bearing member to form an electrostatic latent image on said image bearing member charged by said charging member, developing means for developing said electrostatic latent image by a toner to thereby form a toner image, and transfer means for transferring said toner image from said image bearing member to a transfer material.

6. An image forming apparatus according to claim 1, wherein said charging member is of a roller-like shape.

7. An image forming apparatus according to claim 1, wherein said detecting means detects frequency of image formation.

8. An image forming apparatus according to claim 1, wherein said detecting means detects an electric current passing through said charging member.

9. An image forming apparatus comprising:

a movable image bearing member;

a charging member contacting with said image bearing member and charging said image bearing member;

a cleaning member periodically cleaning said charging member;

detecting means for detecting a parameter related to a deteriorated state of a surface of said image bearing member; and control means for controlling a cleaning ability per cleaning period of said cleaning member.

10. An image forming apparatus according to claim 9, wherein said control means controls a cleaning time of said cleaning member.

11. An image forming apparatus according to claim 10, wherein said control means extends the cleaning time when said image bearing member deteriorates.

12. An image forming apparatus according to claim 9, wherein said cleaning member pressure contacts with said charging member, and said control means controls a pressure contact force of said cleaning member to said charging member.

13. An image forming apparatus according to claim 12, wherein said control means increases the pressure contact force when said image bearing member deteriorates.

14. An image forming apparatus according to claim 9, wherein said detecting means detects a frequency of image formation.

15. An image forming apparatus according to claim 9, wherein said detecting means detects an electric current passing through said charging member.

* * * * *

UNITED STATES PATENT AND TRADEMARK OFFICE

CERTIFICATE OF CORRECTION

PATENT NO. : 6,029,029

DATED : February 22, 2000

INVENTOR(S) : MITSUKA DANZUKA

It is certified that error appears in the above-identified patent and that said Letters Patent is hereby corrected as shown below:

COLUMN 1

Line 24, "power" should read --power,--;

Line 25, "as," should read --as--;

Line 32, "a" should be deleted; and "as" should read --as a--; and

Line 34, "member" should read --member,--.

COLUMN 3

Line 16, " "a " " should read --"a"--.

COLUMN 6

Line 23, should read --a design--.

Signed and Sealed this

Twentieth Day of March, 2001

*Attest:*

Nicholas P. Godici

NICHOLAS P. GODICI

*Attesting Officer*

*Acting Director of the United States Patent and Trademark Office*